US008347833B2

(12) United States Patent
Hu

(10) Patent No.: US 8,347,833 B2
(45) Date of Patent: Jan. 8, 2013

(54) DIESEL TYPE CROSS-CYCLE INTERNAL COMBUSTION ENGINE

(76) Inventor: Lung-tan Hu, Aldergrove (CA)

( * ) Notice: Subject to any disclaimer, the term of this patent is extended or adjusted under 35 U.S.C. 154(b) by 753 days.

(21) Appl. No.: 12/386,040

(22) Filed: Apr. 14, 2009

(65) Prior Publication Data

US 2010/0258066 A1 Oct. 14, 2010

(51) Int. Cl.
*F02B 25/00* (2006.01)

(52) U.S. Cl. ..... 123/70 R; 123/74 R; 123/48 R

(58) Field of Classification Search ..... 123/67, 123/68, 69 R, 69 V, 70 R, 70 V, 316
See application file for complete search history.

(56) References Cited

U.S. PATENT DOCUMENTS 3,623,463 A * 11/1971 De Vries ..... 123/70 R
4,351,290 A * 9/1982 Melchior ..... 123/58.7
5,056,471 A * 10/1991 Van Husen ..... 123/51 R
5,213,067 A * 5/1993 Kramer ..... 123/51 BA
5,243,938 A * 9/1993 Yan ..... 123/197.1
5,456,219 A * 10/1995 Clarke ..... 123/42
5,509,382 A * 4/1996 Noland ..... 123/66
5,542,382 A * 8/1996 Clarke ..... 123/51 AA
6,698,405 B2 * 3/2004 Bigi ..... 123/560
6,841,497 B1 * 1/2005 Krell et al. ..... 501/153
6,852,923 B2 * 2/2005 Perry et al. ..... 174/50
6,871,497 B2 * 3/2005 Isogai ..... 60/598
6,952,923 B2 * 10/2005 Branyon et al. ..... 60/597
2005/0199191 A1 * 9/2005 Loth et al. ..... 123/27 R

* cited by examiner

*Primary Examiner* — Noah Kamen
*Assistant Examiner* — Long T Tran

(57) ABSTRACT

The present invention provides a cross-cycle internal combustion engine that can conduct a combustion cycle called as the cross-cycle with diesel ignition means. The diesel type cross-cycle operation consists of seven processes, which are the intake-process, the cold-compression process, the injection process, the cold-expansion process, the exhaust process, the hot-compression process, and the diesel-ignition process.

3 Claims, 12 Drawing Sheets

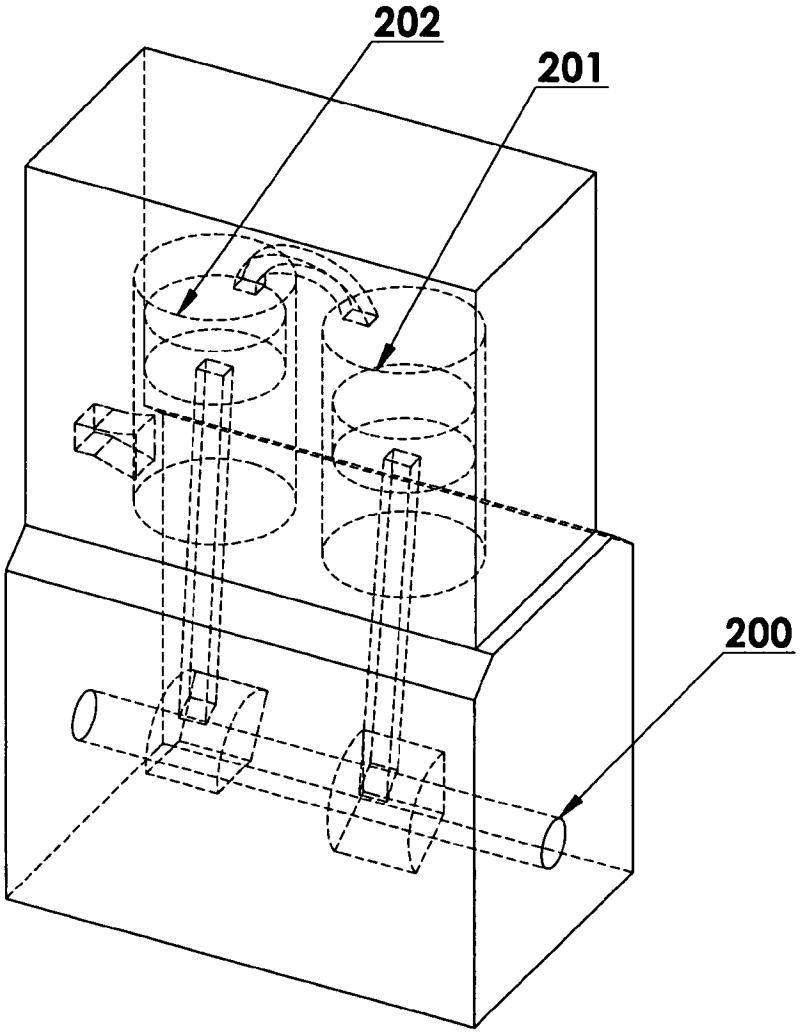
FIG.2 Inline-type Single Crankshaft Configuration

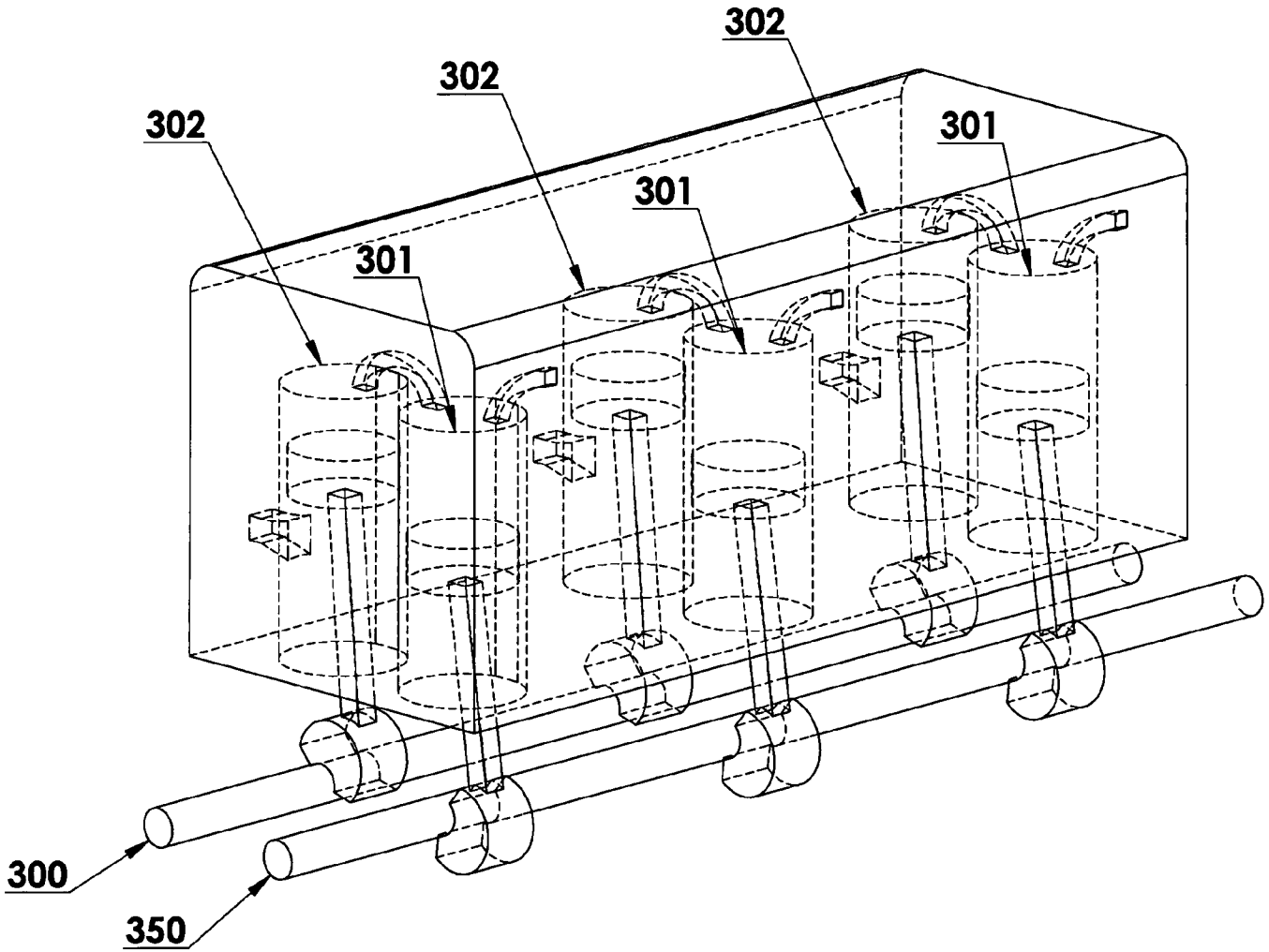
FIG.3 Inline-type Double Crankshaft Configuration

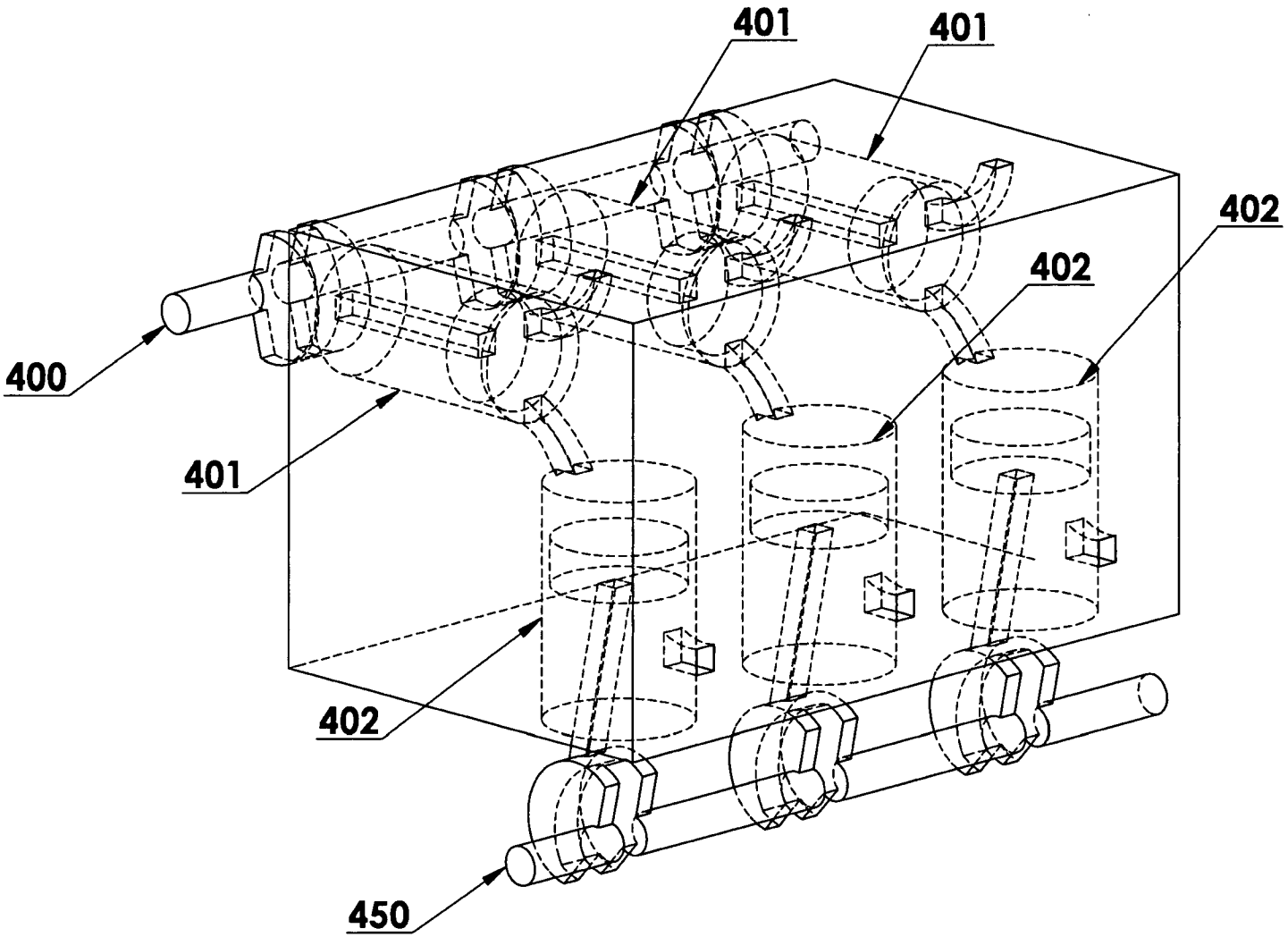
FIG.4 L-Type Double Crankshaft configuration

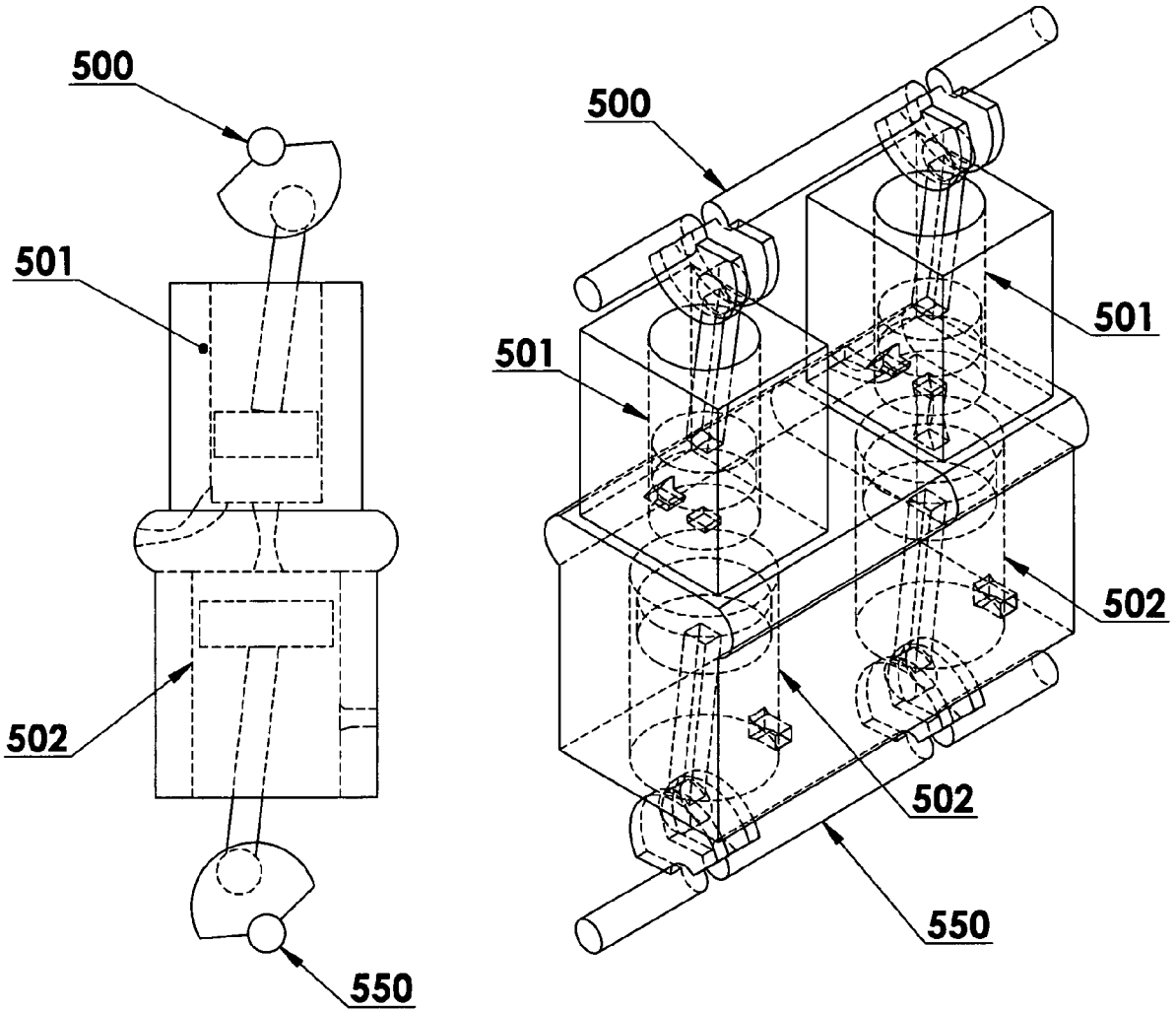
FIG.5 Flat-type Double Crankshaft configuration

DIESEL TYPE CROSS-CYCLE INTERNAL COMBUSTION ENGINE

FIELD

Field of the Invention

The present invention relates to an internal combustion engine that operates with the diesel type cross-cycle, more particularly relates to an internal combustion engine that utilizes diesel ignition means to conduct the seven processes of the cross-cycle.

The present invention can be used in the field of power generation and transportation.

BACKGROUND OF THE INVENTION

During the past twenty years, my research has focused on the power-to-weight ratio and heat-loss reduction of the compound cylinders configuration; after years of experiments, the cross-cycle operation is developed to achieve a combustion process with minimum heat loss and high power output.

This present invention is one of the possible engine configurations utilizing the cross-cycle concept, further improvements on the cross-cycle operation may be achieved in the near future; and it is my earnest wish that the information disclosed herein could make a contribution to greenhouse gas reduction and engine research.

SUMMARY OF THE INVENTION

1. The primary objective of the present invention is to provide a diesel type cross-cycle internal combustion engine that is capable of conducting the cross-cycle operation with diesel ignition means; said cross-cycle operation generates a relatively stable power output which reduces the engine vibration and the heat loss of the engine cooling system in comparison to current diesel engines.

2. The second objective of the present invention is to provide a diesel type cross-cycle internal combustion engine that is capable of fast acceleration and high power output.

BRIEF DESCRIPTIONS OF THE DRAWINGS

FIG. 2 shows the Inline-type single crankshaft configuration of the diesel type cross-cycle engine.

FIG. 3 shows the Inline-type double-crankshaft configuration of the diesel type cross-cycle engine FIG. 4 shows the L-type double crankshaft configuration of the diesel type cross-cycle engine.

FIG. 5 shows the Flat-type double crankshaft configuration of the diesel type cross-cycle engine.

Table. 2 demonstrates an example of the diesel type cross-cycle with a piston-phase-difference of 45 degree.

Table. 3 demonstrates an example of the diesel type cross-cycle with a piston-phase-difference of 60 degree.

Table. 4 demonstrates an example of the diesel type cross-cycle with a piston-phase-difference of 90 degree.

Table 5 demonstrates an example of the diesel type cross-cycle with a piston-phase-difference of 120 degree.

DESCRIPTION OF THE PREFERRED EMBODIMENTS

The diesel type cross-cycle internal combustion engine can also be abbreviated as the diesel type cross-cycle engine.

The diesel type cross-cycle consists of seven processes, and requires at least one male-cylinder and one female-cylinder to co-act with each other; many cylinder arrangements can be employed with the present invention, however, the first embodiment will explain with the simplest cylinder arrangement, namely the Inline-type single crankshaft configuration.

The piston-phase-difference is a specific term referring to the piston position difference between the male-piston and the female-piston, and said piston-phase-difference of the diesel type cross-cycle engine can be adjusted from 30 degree to 120 degree depending on the applications and the material strength of the engine head. As a comprehensive reference, Table. 1 to Table. 5 are presented to demonstrate the possible alternation of the diesel type cross-cycle with various piston-phase-difference configurations; Table. 1 demonstrates the diesel type cross-cycle with a piston-phase-difference of 30 degree, Table. 5 demonstrates the diesel type cross-cycle with a piston-phase-difference of 120 degree, wherein the smaller phase-piston-difference generally requires higher material strength for the engine body and the engine head, Table. 2 demonstrates the diesel type cross-cycle with a piston-phase-difference of 45 degree, Table. 3 demonstrates the diesel type cross-cycle with a piston-phase-difference of 60 degree, Table. 4 demonstrates the diesel type cross-cycle with a piston-phase-difference of 90 degree.

It should be understood that the first embodiment will be using Table. 2 and FIG. 1A to FIG. 1G to explain the configuration of the inline-type single crankshaft with a piston phase difference of 45 degree for the demonstration purpose, this specific configuration is only one of the many possible configurations of the present invention, rather than the limitations of the duration of each process or the valve timing.

The specific terminology of the diesel type cross-cycle internal combustion engine will be defined as follows.

The diesel type cross-cycle operation consists of seven processes, and the seven processes are named in the following order as the intake process, the cold-compression process, the injection process, the cold-expansion process, the exhaust process, the hot-compression process, the diesel-ignition process.

Figure 1A:
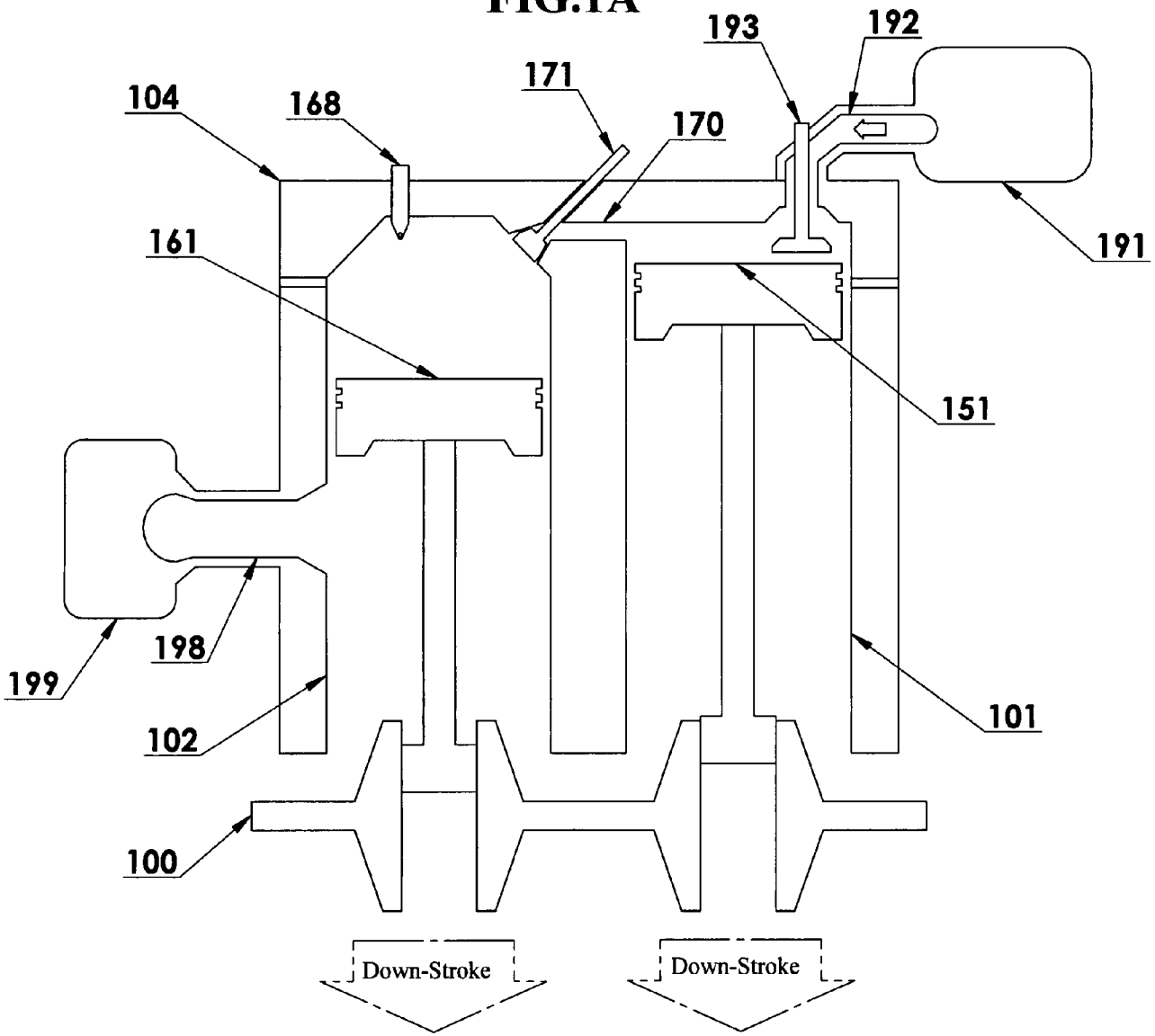
FIG. 1A shows the first process of the diesel type cross-cycle of the first embodiment.

As shown in FIG. 1A is the diesel type cross-cycle internal combustion engine with the inline-type single crankshaft configuration; the basic components are labeled as follows, the crankshaft 100, the male-cylinder 101, the male-piston 151, the female-cylinder 102, the female-piston 161, the male-intake-port 192, the male-intake-valve 193, the coordinate-port 170, the coordinate-valve 171, the female-exhaust-port 198, the intake-manifold 191, the exhaust-manifold 199, the high-pressure-injector 168, the engine head 104.

The coordinate-port 170 provides an air passage from the male-cylinder 101 to the female-cylinder 102, and the coordinate-valve 171 is a valve equipped on the female cylinder end of the coordinate-port 170, therefore the air pressure of the coordinate-port 170 is equal to the air pressure of the male-cylinder 101 when the coordinate-valve 171 is closed.

The high-pressure-injector 168 is a fuel injector that will directly inject the fuel into the female-cylinder 102 during the seventh process of the diesel type cross-cycle operation, and said high-pressure-injector 168 is preferably installed on the female cylinder section of the engine head 104 in the most cylinder arrangements; it is also possible to install said high-pressure-injector 168 on the top section of the female cylinder wall.

The fuel used for the present invention is mainly diesel, fossil-fuel, bio-fuel, methanol, or a combination of the fuels that require the diesel-ignition means.

The female-exhaust-port 198 is an exhaust port located on the lower section of the female cylinder wall, and which provides an air passage to expel the cold-expanding-medium inside the female-cylinder 102 to the exhaust-manifold 199 during the exhaust process of the diesel type cross-cycle operation.

Now referring from FIG. 1A to FIG. 1G for the main concept of the diesel type cross-cycle operation. FIG. 1A shows the beginning of the first process of the diesel type cross-cycle operation, said first process is called as the intake process; during the first process, the male-intake-valve 193 will open to supply air into the male-cylinder 101 when the male-piston 151 moves toward BDC (bottom dead centre).

Figure 1B:
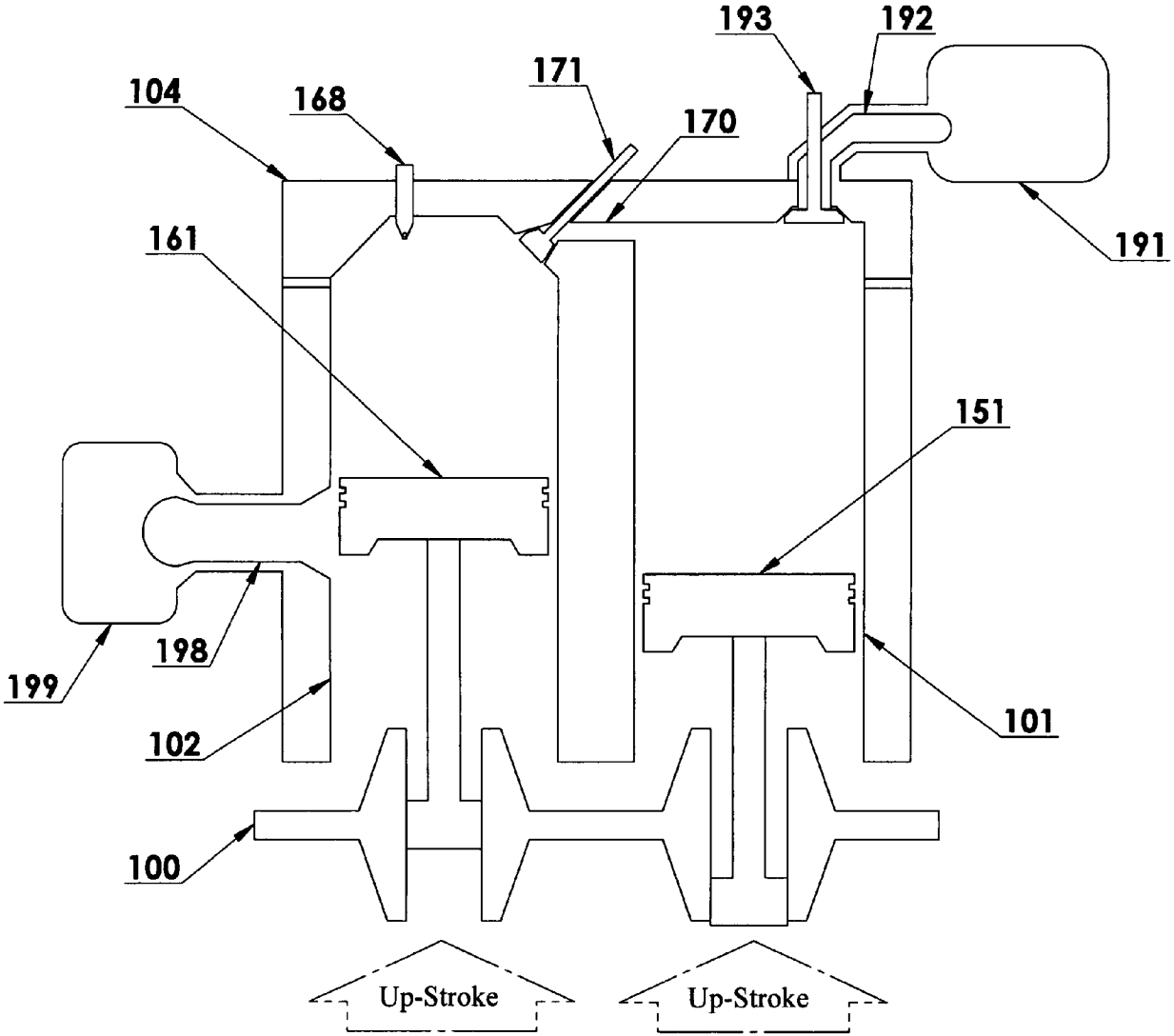
FIG. 1B shows the second process of the diesel type cross-cycle of the first embodiment.

FIG. 1B shows the beginning of the second process of the diesel type cross-cycle operation, said second process is called as the cold-compression process; during the second process, the male-piston 151 moves toward TDC (top dead centre) to compress the air in the male-cylinder 101.

Figure 1C:
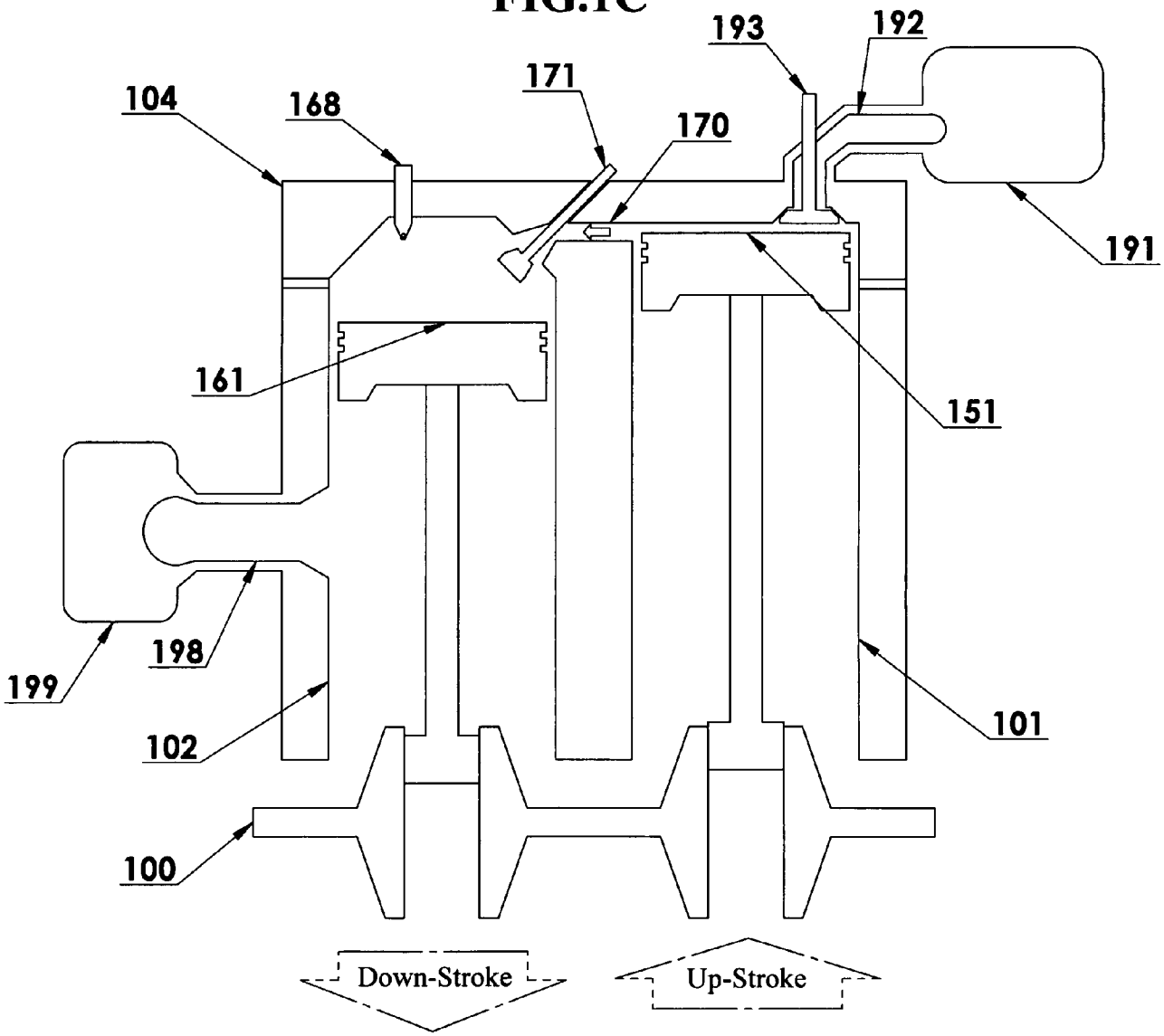
FIG. 1C shows the third process of the diesel type cross-cycle of the first embodiment.

FIG. 1C shows the beginning of the third process of the diesel type cross-cycle operation, said third process is called as the injection process; during the third process, the high-density air of the male-cylinder 101 is injected into the female-cylinder 102 through the coordinate-port 170, and the air pressure of the coordinate-port 170 requires to be higher than the combusting pressure of the female-cylinder 102 prior to the initiation of the injection process.

A more detailed description of said injection process will be provided as follows; the female-cylinder 102 will ignite and expand with the hot-combusting-medium of the previous diesel type cross-cycle before the injection process initiates. As the female-piston 161 moves toward BDC, the combusting pressure of the female-cylinder 102 will decrease to a point that the air pressure of the coordinate-port 170 is greater than the combusting pressure of the female-cylinder 102, at this time the injection process will be initiated by opening the coordinate-valve 171. As the injection process starts, the high-density air is injected into the female cylinder 102 to mix with the hot-combusting-medium of the female-cylinder 102 to form a cold-expanding-medium in the female-cylinder 102, and said cold-expanding-medium will expand at a high-density with excessive oxygen content. Generally, the coordinate-valve 171 can remain opening until the male-cylinder 101 initiates the first process of the next cycle, however it is preferable to shut the coordinate valve 171 immediately after the air pressure of the coordinate-port 170 is equal to the combusting pressure of the female-cylinder 102 to prevent turbulence. During the injection process, the female-piston 161 will continue to generate power to the crankshaft 100.

Figure 1D:
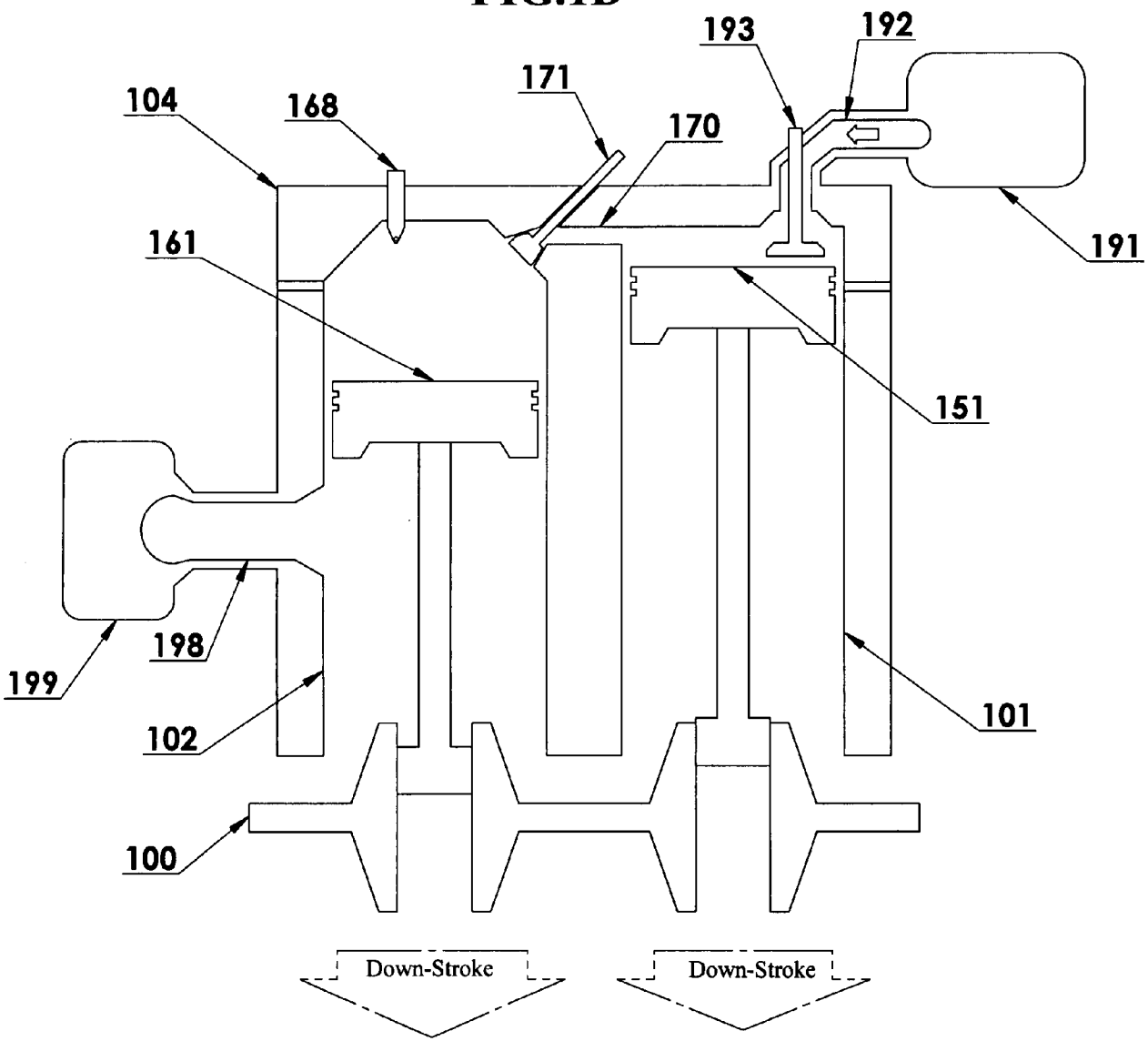
FIG. 1D shows the fourth process of the diesel type cross-cycle of the first embodiment.

FIG. 1D shows the beginning of the fourth process of the diesel type cross-cycle operation, said fourth process is called as the cold-expansion process; the cold-expansion process will initiate when the cold-expanding-medium has formed inside the female cylinder 102; the cold-expanding-medium will generate power to the crankshaft 100 as the female-piston 161 continues to move toward BDC.

Figure 1E:
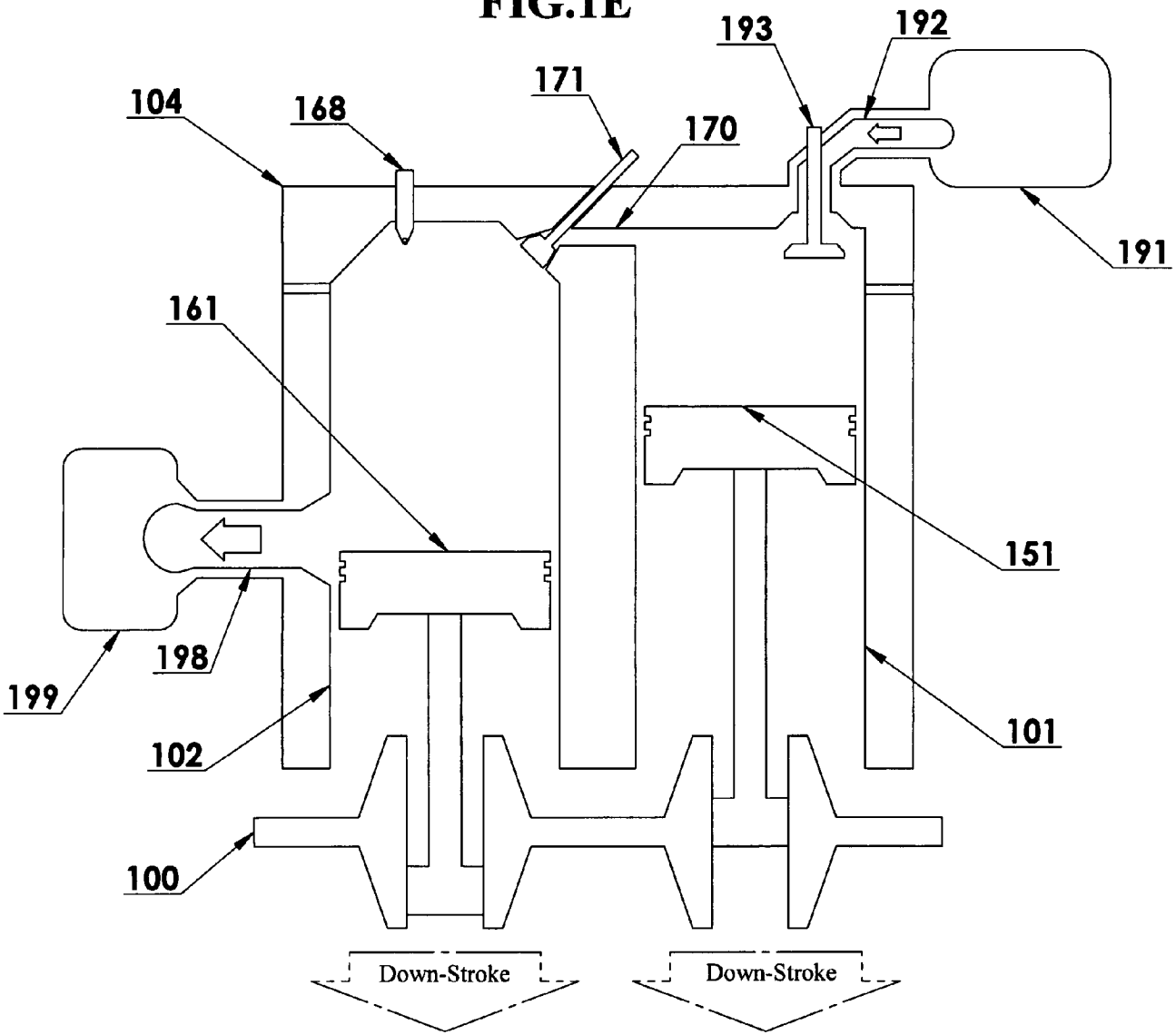
FIG. 1E shows the fifth process of the diesel type cross-cycle of the first embodiment

FIG. 1E shows the beginning of the fifth process of the diesel type cross-cycle operation, said fifth process is called as the exhaust process; during the exhaust process, a portion of the cold-expanding-medium of the female-cylinder 102 will flow out through the female-exhaust-port 198 when the female-piston 161 slides down the lower section of the female cylinder wall; the cold-expanding-medium will continue to flow out of the female-cylinder until the female-piston 161 moves up and closes the female-exhaust-port 198 on the female cylinder wall. At the end of the exhaust process, at least 10% of the cold-expanding-medium will remain in the female-cylinder 102, and said cold-expanding-medium is a mixture of oxygen and carbon dioxide and nitrogen. The remaining percentage of said cold-expanding medium may vary from 10% to about 70% depending on the rpm and load conditions, and said remaining portion of the cold-expanding-medium in the female-cylinder 102 will be referred to as the remaining-medium after the exhaust process has completed.

Figure 1F:
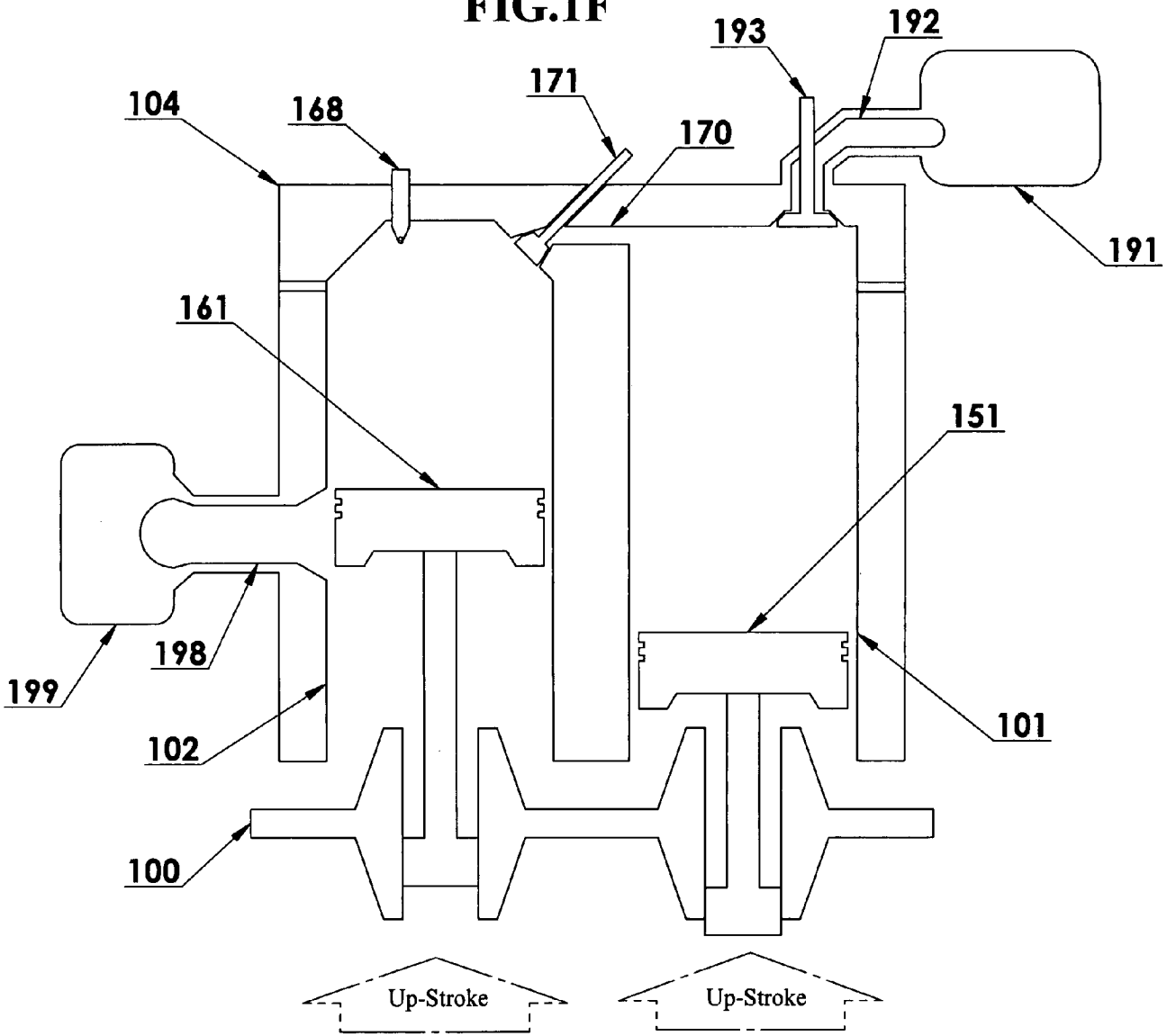
FIG. 1F shows the sixth process of the diesel type cross-cycle of the first embodiment.

FIG. 1F shows the beginning of the sixth process of the diesel type cross-cycle operation, said sixth process is also called as the hot-compression process; during the hot-compression process, the female-piston 161 will continue to move toward TDC to compress the remaining-medium inside the female-cylinder 162; at the end of the hot-compression process, said remaining-medium will be compressed to a pressure high enough to ignite diesel.

Figure 1G:
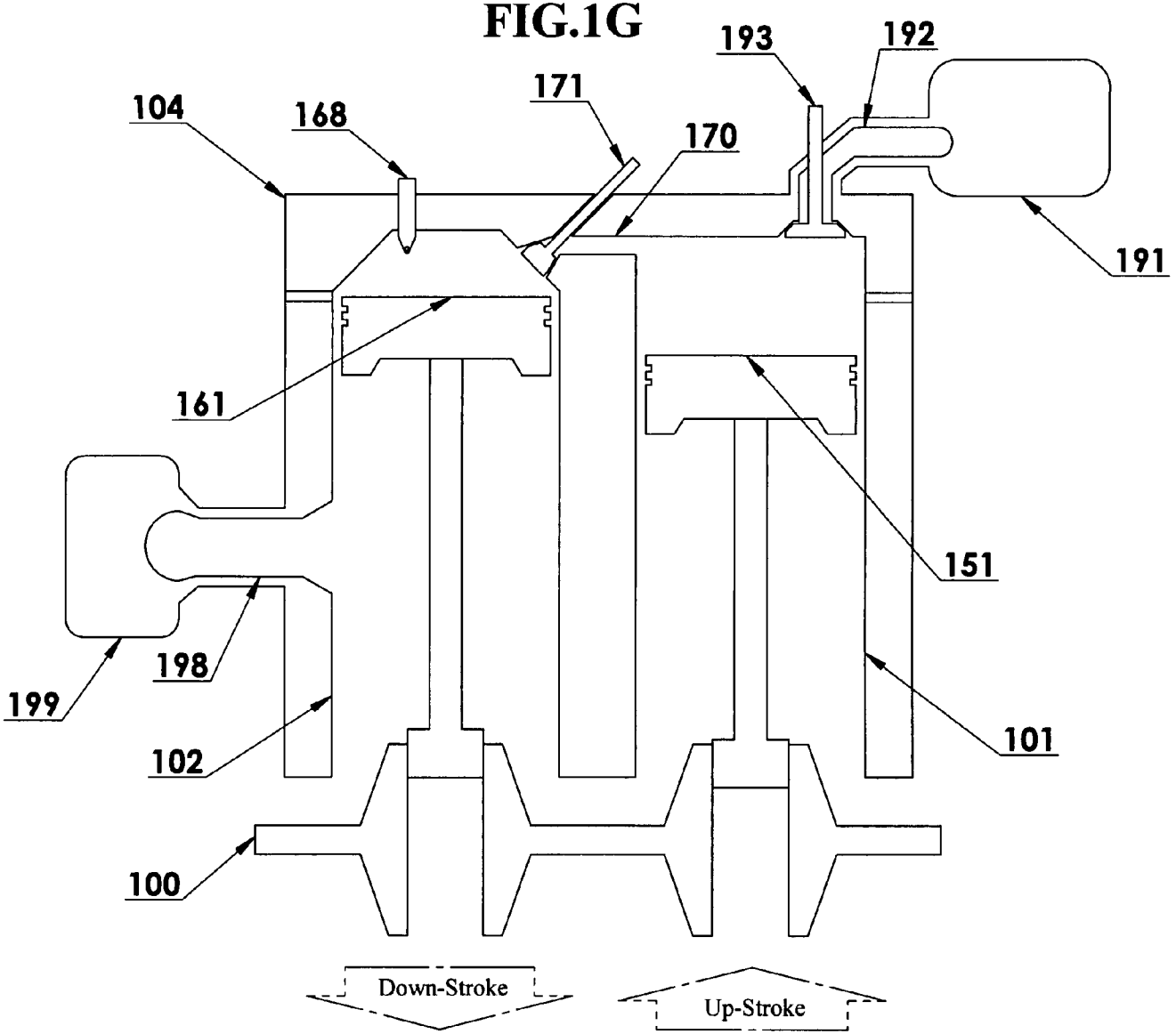
FIG. 1G shows the seventh process of the diesel type cross-cycle of the first embodiment.

FIG. 1G shows the beginning of the seventh process of the diesel type cross-cycle operation, said seventh process is called as the diesel-ignition process; during the diesel-ignition process, the high-pressure injector 168 will inject the fuel into the female-cylinder 102 to initiate the diesel-ignition process when the female-piston 161 is at about TDC position, (the beginning of the ignition can be set between 35 degree prior to TDC position and 35 degree after TDC position, while the high-pressure injector can supply fuel between 45 degree prior to TDC position and 90 degree after TDC position according to the engine applications and load conditions). After the ignition, the hot-combusting-medium inside the female-cylinder 102 will expand and decrease in combusting pressure as the female-piston 161 moves toward BDC; meanwhile the male-piston 151 is moving toward TDC to compress the air to the coordinate-port 170. At the point when the coordinate-port 170 has a higher air pressure than the combusting pressure of the female-cylinder 102, the injection process of the next diesel type cross-cycle operation will initiate and thereby completing the present cycle of the diesel type cross-cycle operation.

The above description is the main concept of the present invention, however, the diesel type cross-cycle is relatively complicated than four-stroke diesel internal combustion engines, therefore, an alternative narration with crankshaft reference angle is provided as follows; it should be understood that the crankshaft reference angle described with each process is not a limitation of the process durations or the valve timings; therefore, the following narration of the crankshaft reference angle only represents as one of the many possible embodiments of the present invention; even though this following narrative embodiment is not the most ideal configuration in terms of heat-loss reduction, it can be considered as the most comprehensive description for those skilled in the art of four-stroke internal combustion engines.

The following is the narration of the first embodiment with crankshaft reference angle, wherein, Table. 2 and FIG. 1A to FIG. 1G can be used as a reference:

The diesel type cross-cycle operation consists of seven processes, and the seven processes are named as the intake process, the cold-compression process, the injection process, the cold-expansion process, the exhaust process, the hot-compression process, the diesel-ignition process.

For the diesel type cross-cycle engine configured with the piston-phase-difference of 45 degree as in Table. 2, the male-piston 151 is at TDC position at 0 degree of the crankshaft reference angle, and the male-piston 151 is at BDC position at 180 degree of the crankshaft reference angle, and the male-piston 151 is at TDC position at 360 degree of the crankshaft reference angle; the female-piston 161 is at TDC position at 315 degree of the crankshaft reference angle, and the female-piston 161 is at BDC position at 495 degree of the crankshaft reference angle, and the female-piston 161 is at TDC position at 675 degree of the crankshaft reference angle.

The first process, the intake process, is to take in the air into the male-cylinder 151 from approximately 0 degree to 180 degree of the crankshaft reference angle.

The second process, the cold compression process, is to compress the air inside the male-cylinder 101 with the male-piston 151 from approximately 180 degree to 345 degree of crankshaft reference angle.

The third process, the injection process, is to inject the high-density air of the male-cylinder 101 into the female-cylinder 102 when the combusting pressure of female-cylinder 102 is lower than the air pressure of the coordinate-port 170, thereby forming a cold-expanding-medium in the female-cylinder 102; said injection process will take place from approximately 345 degree to 360 degree of the crankshaft reference angle.

The fourth process, the cold-expansion process, is to generate power to the crankshaft 100 with the cold-expanding-medium while the female-piston 161 continues to move toward BDC from approximately 360 degree to 455 degree of the crankshaft reference angle (the end of cold-expansion process is depending on the position and the shape of the female-exhaust-port, 455 degree of the crankshaft reference angle is only for the demonstration purpose in this particular embodiment).

The fifth process, the exhaust process, is to expel up to 90% of the cold-expanding-medium through the female-exhaust-port 198 from approximately 455 degree to 535 degree of the crankshaft reference angle (this duration of the exhaust process is depending on the position and the shape of the female-exhaust-port 198, the actual duration of the exhaust process can vary from 60 degree to 180 degree for the different applications). The remaining portion of said cold-expanding-medium in the female cylinder 102 will be referred as the remaining-medium after the exhaust process has completed.

The sixth process, the hot compression process, is to compress said remaining-medium inside the female-cylinder 102 from approximately 535 degree to 675 degree of the crankshaft reference angle; at the end of the hot compression process, the remaining-medium will have an adequate pressure for the diesel-ignition.

The seventh process, the diesel-ignition process, is to ignite the remaining-medium by injecting fuel at a high pressure into the female-cylinder 102 with the high-pressure injector 168; after the ignition occurs in the female-cylinder 102, the hot-combusting-medium will push the female-piston 161 toward BDC to generate power from approximately 675 degree to 690 degree of the crankshaft reference angle. At approximately 690 degree of the crankshaft reference angle, the coordinate-port 170 will have a higher air pressure than the combusting pressure of the female cylinder 102 (the actual timing of this moment may vary according to the intake amount of the male-cylinder and the engine load conditions), at this time, the injection process of the next diesel type cross-cycle operation will take over, and thereby completing the present cycle of the diesel type cross-cycle operation.

The high-pressure injector 168 can continue to inject fuel into the female-cylinder 102 after the injection process has initiated; in the case of the large engine application, the high-pressure injector 168 can continue to supply a small amount of fuel into the female-cylinder to boost power until 90 degree after the TDC position of the female-piston 161.

Now referring from FIG. 2 to FIG. 6 to demonstrate the alternative cylinder configurations of the diesel type cross-cycle engine; as these drawing are only for exemplars of the different cylinder configurations, detailed components of the diesel type cross-cycle engine are not shown, and these drawings do not represent the ignition sequence or the crankshaft balancing; the ignition sequence and the crankshaft balancing will not be discussed here since the related knowledge is common to those skilled in the art of internal combustion engines.

FIG. 2 shows the inline-type single crankshaft configuration of the diesel type cross-cycle engine, wherein the male-cylinder 201 and the female-cylinder 202 will share and rotate with a common crankshaft 200; this configuration can further extend to the inline-type single crankshaft configurations and the V-type single crankshaft configurations and the H-type single crankshaft configuration, wherein multiple sets of the female-cylinders and male-cylinders will be operating with a common crankshaft.

FIG. 3 shows the Inline-type double crankshaft configuration of the diesel type cross-cycle engine, wherein all the male-piston will reciprocate with a male-crankshaft 300, while all the female-piston will reciprocate with a female-crankshaft 350. Each male-cylinder 301 and its corresponding female cylinder 302 can also be disposed at an angle for balancing purpose or minimizing the space required; for those cylinder arrangement that disposed at an angle other than 180 degree and 90 degree can be called as the A-type double crankshaft configuration; all the double crankshaft configurations will require the synchronizing means such as belt or chains or gears to rotate the male-crankshaft and the female-crankshaft at the same rotation speed.

FIG. 4 shows the L-type double crankshaft configuration of the diesel type cross-cycle engine, wherein, all the male-piston will reciprocate with a male-crankshaft 400, and all the female-piston will reciprocate with a female-crankshaft 450, wherein each female-cylinder 402 and its corresponding male-cylinder 401 are disposed at 90 degree.

FIG. 5 shows the Flat-type double crankshaft configuration, wherein the all the male-pistons will reciprocate with a male-crankshaft 400, and all the female-pistons will reciprocate with a female-crankshaft 450, and the centre of the female cylinder 402 can be collinear to the centre of the male cylinder 401, such configuration can have a coordinate-port located near the center of the female cylinder 402, therefore, the turbulence can be minimized compared to other cylinder arrangements. An off-centre configuration can also be used for the ease of production and valve arrangements, wherein each male-cylinder is disposed in 180 degree with its corresponding female-cylinder with an off-set distance.

Figure 6:
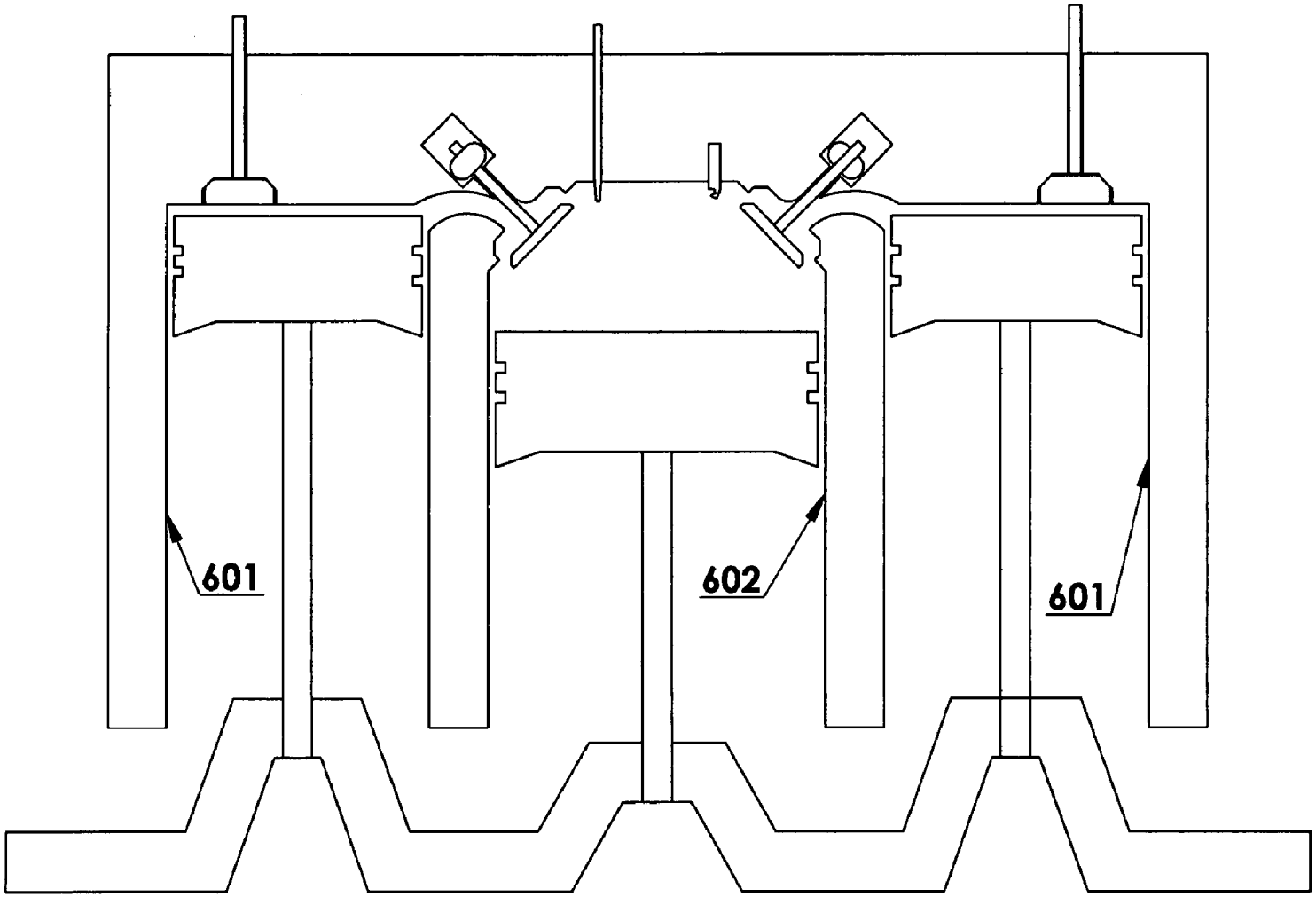
FIG. 6 shows the twin-male configuration of the diesel type cross-cycle engine Table. 1 demonstrates an example of the diesel type cross-cycle with a piston-phase-difference of 30 degree.

FIG. 6 shows a twin-male configuration of the diesel type cross-cycle engine, wherein one female-cylinder 601 is coupled with two male-cylinders 602, wherein said two male-cylinders 602 will both inject the high-density air into the female-cylinder 601 during the injection process; the twin-male cylinder configuration can improve the overall performance of the injection process by decreasing the hot spots and overall temperature of the engine head. Said two male-cylinders are preferably set-up at the exact same phase to initiate the injection process at the same time, however, it is possible to have a small phase difference of up to 45 degree for the two male-cylinders for some large engine applications.

The coordinate-valve can be constructed as a type of swing-check valves or spring-check valves, wherein the coordinate-valve will be actuated with the high-density air of the coordinate-port when the air pressure of the coordinate-port is greater than the combined force of the combusting medium of the female-cylinder and the spring tension on the coordinate-valve.

The coordinate-valve can also be constructed as an enclosed valve, wherein the spring and the valve body of the coordinate-valve are concealed inside the coordinate-port or in a concealed space with an equal pressure of the coordinate-port, thus preventing the high-density air from leaking out of the coordinate-port.

The coordinate-valve can also be actuated with a variable-timing-camshaft, so that the valve open duration and valve schedule can be adjusted to maximize the engine performance for different load conditions.

The coordinate-valve can also be a hydraulic-valve or an electromagnetic-valve.

The coordinate-port can also be constructed with multiple coordinate-valves, wherein the coordinate-port can inject the high-density air into the female-cylinder at multiple spots to improve the overall performance of the injection process.

The duration of the exhaust process can adjust from 60 degree to 180 degree of crankshaft rotation by the position and the shape of the female-exhaust-port. At least 10% of the cold-expansion-medium will be required to remain in the female-cylinder when the exhaust process has completed.

The duration of the injection process of the diesel type cross-cycle operation can vary from 3 degree to 90 degree of crankshaft rotation for different engine operation conditions, wherein the coordinate-valve can start to open after the air pressure of the coordinate-port is higher than the combusting pressure of the female-cylinder, while the coordinate-valve can start to close after the air pressure of the coordinate-port is about equal to the pressure of the female-cylinder. The duration of the injection process of the diesel type cross-cycle operation can be even shortened for the low-rpm large engines, wherein the shorter duration can result in a better heat-loss reduction.

Among all the possible configurations of the present invention, the preferable configurations are the ones that can minimize the duration of the hot-expansion process and the injection process without damaging the engine components, thereby increasing the duration of the cold-expansion process to reduce the heat loss resulted from the spark-ignition type cross-cycle operation.

The ignition of the female-cylinder can be initiated at any point between 35 degree prior to TDC position and 35 degree after TDC position with one or more high-pressure injectors.

The high-pressure injector can supply a small amount of fuel into the female-cylinder during the hot-compression process to pre-heat with the remaining-medium before the initiation of the diesel-ignition process.

The high-pressure injector can be replaced with one or more diesel fuel pumps to reduce the manufacturing cost.

10% to 70% of the cold-expanding-medium will remain in said female-cylinder at the end of the exhaust process and the duration of the exhaust process can range from 60 degree to 120 degree of crankshaft rotation; the minimum duration is from 30 degree before the BDC position of said female-piston to 30 degree after the BDC position of said female-piston, while the maximum duration is from 90 degree before the BDC position of said female-piston to 90 degree after the BDC position of said female-piston.

TABLE 1

Diesel type cross-cycle with the piston-phase-difference of 30 degree

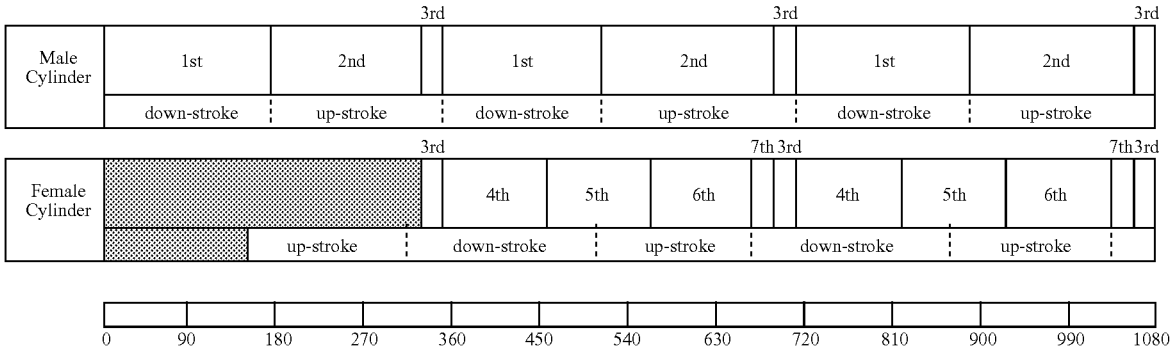

Note:

1st = the intake process

2nd = the cold-compression process

3rd = the injection process

4th = the cold-expansion process

5th = the exhaust process

6th = the hot-compression process

7th = the diesel-ignition process

TABLE 2

Diesel type cross-cycle with the piston-phase-difference of 45 degree

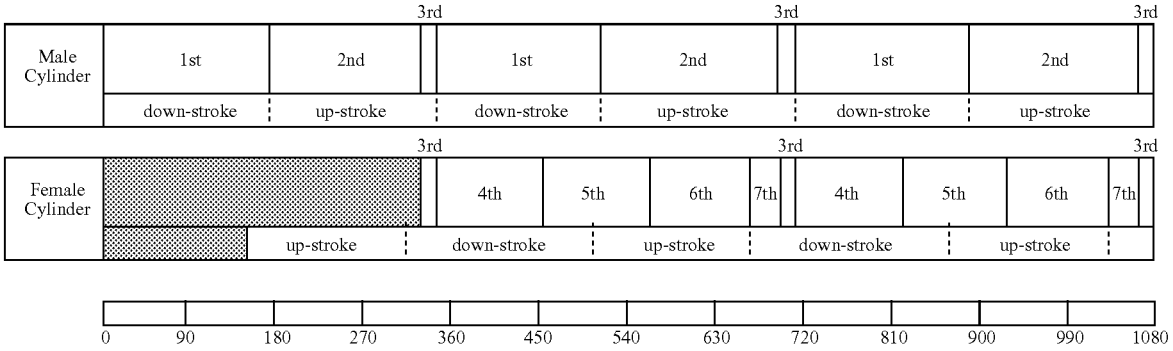

Note:

1st = the intake process

2nd = the cold-compression process

3rd = the injection process

4th = the cold-expansion process

5th = the exhaust process

6th = the hot-compression process

7th = the diesel-ignition process

TABLE 3

Diesel type cross-cycle with the piston-phase-difference of 60 degree

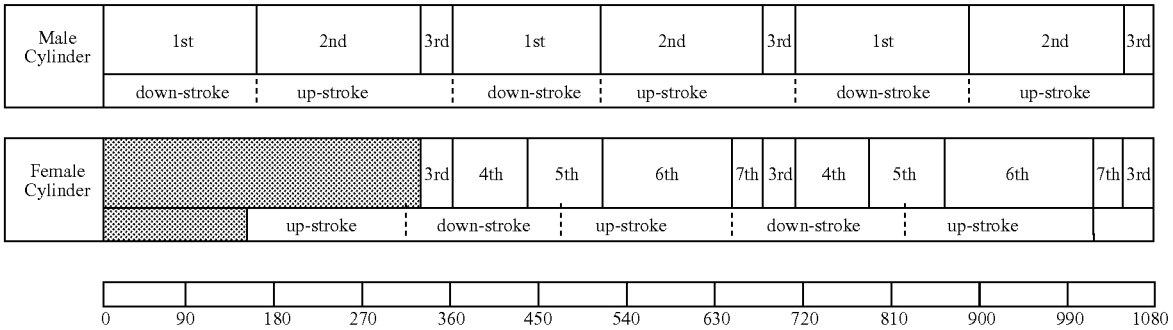

Note:

1st = the intake process

2nd = the cold-compression process

3rd = the injection process

4th = the cold-expansion process

5th = the exhaust process

6th = the hot-compression process

7th = the diesel-ignition process

TABLE 4

Diesel type cross-cycle with the piston-phase-difference of 90 degree

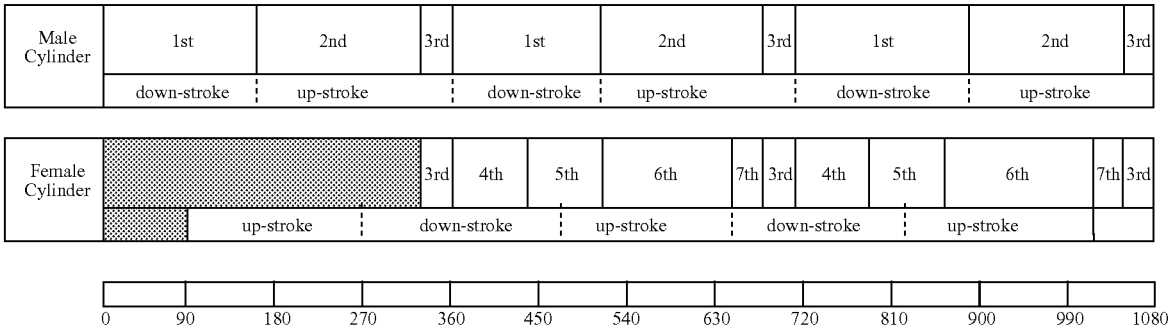

Note:
1st = the intake process
2nd = the cold-compression process
3rd = the injection process
4th = the cold-expansion process
5th = the exhaust process
6th = the hot-compression process
7th = the diesel-ignition process

TABLE 5

Diesel type cross-cycle with the piston-phase-difference of 120 degree

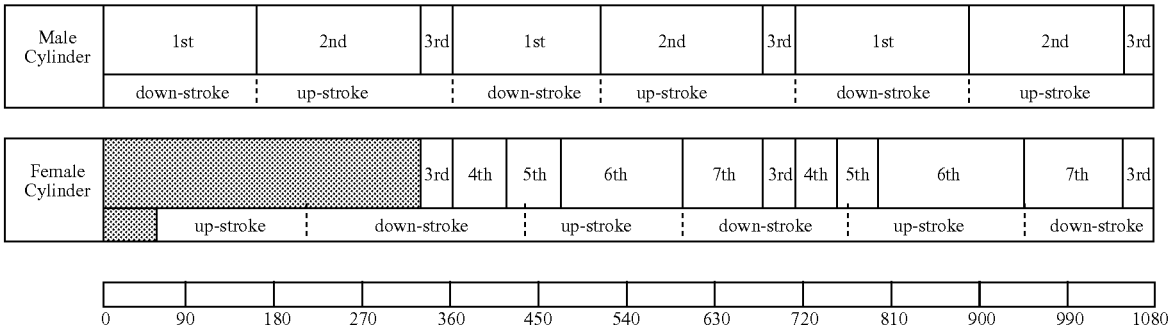

Note:
1st = the intake process
2nd = the cold-compression process
3rd = the injection process
4th = the cold-expansion process
5th = the exhaust process
6th = the hot-compression process
7th = the diesel-ignition process

The invention claimed is:

1. A diesel type cross-cycle internal combustion engine comprising:

a) at least one set of a male-cylinder and a female-cylinder for performing a cross-cycle;

b) a male-piston reciprocating within the male-cylinder;

c) a female-piston reciprocating within the female-cylinder;

d) an air-intake-valve for admission of air into the male-cylinder;

e) a fuel-supplying means and a diesel-ignition means, installed on an engine head of the female-cylinder, for initiating a hot-combustion, of fuel and a cold-expansion-medium remained from an exhaust process of a previous cross-cycle, before TDC of the female-piston;

f) an exhaust-port, installed on the lower portion of the female-cylinder, for effecting a direct expelling-passage in the female-cylinder when the female-piston reciprocating over the lower portion of the female-cylinder; and g) a coordinate-valve, which is a type of spring-check-valves or swing-check-valves, installed on the engine head of the female-cylinder and served as a check-valve of compressed air from the male-cylinder, for effecting an injection of compressed air which cools down a working medium, of the hot-combustion in the female-cylinder, into a cold-expansion-medium of carbon-dioxide gas, oxygen gas, and nitrogen gas, wherein:

a portion of said cold-expansion-medium, in the female-cylinder, is expelled directly throughout the exhaust-port during the exhaust-process that are set, by the shape and the position of the exhaust-port, within a range from 90 degree before BDC of the female-piston to 90 degree after BDC of the female-piston;

a remaining portion of said cold-expansion-medium, in the female-cylinder after the exhaust-process, has an oxygen concentration high enough to initiate a hot-combustion of a next cross-cycle;

said injection of compressed air decreases overall temperature, of the engine head of the female-cylinder, and eliminates any hot spot on the engine head surface of the female-cylinder to reduce heat loss; and said coordinate-valve is opened when the air pressure of said coordinate-port is higher than the combined forced of the spring tension and the combusting pressure applied on said coordinate-valve to begin said injection of compressed air.

2. A diesel type cross-cycle internal combustion engine comprising:

a) at least one set of a male-cylinder and a female-cylinder for performing a cross-cycle;

b) a male-piston reciprocating within the male-cylinder;

c) a female-piston reciprocating within the female-cylinder;

d) an air-intake-valve for admission of air into the male-cylinder;

e) a fuel-supplying means and a diesel-ignition means, installed on an engine head of the female-cylinder, for initiating a hot-combustion, of fuel and a cold-expansion-medium remained from an exhaust process of a previous cross-cycle, before TDC of the female-piston;

f) an exhaust-port, installed on the lower portion of the female-cylinder, for effecting a direct expelling-passage in the female-cylinder when the female-piston reciprocating over the lower portion of the female-cylinder; and g) a coordinate-valve, which is actuated by a electromagnetic mechanism or hydraulic mechanism, installed on the engine head of the female-cylinder and served as a check-valve of compressed air from the male-cylinder, for effecting an injection of compressed air which cools down a working medium, of the hot-combustion in the female-cylinder, into a cold-expansion-medium of carbon-dioxide gas, oxygen gas, and nitrogen gas, wherein:

a portion of said cold-expansion-medium, in the female-cylinder, is expelled directly throughout the exhaust-port during the exhaust-process that are set, by the shape and the position of the exhaust-port, within a range from 90 degree before BDC of the female-piston to 90 degree after BDC of the female-piston;

a remaining portion of said cold-expansion-medium, in the female-cylinder after the exhaust-process, has an oxygen concentration high enough to initiate a hot-combustion of a next cross-cycle;

said injection of compressed air decreases overall temperature, of the engine head of the female-cylinder, and eliminates any hot spot on the engine head surface of the female-cylinder to reduce heat loss; and said coordinate-valve is opened when the air pressure of said coordinate-port is higher than the combined forced of the spring tension and the combusting pressure applied on said coordinate-valve to begin said injection of compressed air.

3. A diesel type cross-cycle internal combustion engine comprising:

a) at least one set of a male-cylinder and a female-cylinder for performing a cross-cycle;

b) a male-piston reciprocating within the male-cylinder;

c) a female-piston reciprocating within the female-cylinder; wherein said male-piston and female-piston are connected to a crankshaft with a phase-difference of 30-120 degree of crankshaft rotation;

d) an air-intake-valve for admission of air into the male-cylinder;

e) a fuel-supplying means and a diesel-ignition means, installed on an engine head of the female-cylinder, for initiating a hot-combustion, of fuel and a cold-expansion-medium remained from an exhaust process of a previous cross-cycle, before TDC of the female-piston;

f) an exhaust-port, installed on the lower portion of the female-cylinder, for effecting a direct expelling-passage in the female-cylinder when the female-piston reciprocating over the lower portion of the female-cylinder; and g) a coordinate-valve, which is a type of spring-check-valves or swing-check-valves, installed on the engine head of the female-cylinder and served as a check-valve of compressed air from the male-cylinder, for effecting an injection of compressed air which cools down a working medium, of the hot-combustion in the female-cylinder, into a cold-expansion-medium of carbon-dioxide gas, oxygen gas, and nitrogen gas, wherein:

a portion of said cold-expansion-medium, in the female-cylinder, is expelled directly throughout the exhaust-port during the exhaust-process that are set, by the shape and the position of the exhaust-port, within a range from 90 degree before BDC of the female-piston to 90 degree after BDC of the female-piston;

a remaining portion of said cold-expansion-medium, in the female-cylinder after the exhaust-process, has an oxygen concentration high enough to initiate a hot-combustion of a next cross-cycle;

said injection of compressed air decreases overall temperature, of the engine head of the female-cylinder, and eliminates any hot spot on the engine head surface of the female-cylinder to reduce heat loss; and said coordinate-valve is opened when the air pressure of said coordinate-port is higher than the combined forced of the spring tension and the combusting pressure applied on said coordinate-valve to begin said injection of compressed air.

* * * * *